US006800810B1

(12) United States Patent
Page

(10) Patent No.: US 6,800,810 B1
(45) Date of Patent: Oct. 5, 2004

(54) SNAKE FOR MUSICAL INSTRUMENT WIRING

(76) Inventor: William Jody Page, 5209 Birchleaf Dr., Raleigh, NC (US) 27606

( * ) Notice: Subject to any disclaimer, the term of this patent is extended or adjusted under 35 U.S.C. 154(b) by 8 days.

(21) Appl. No.: 10/375,432

(22) Filed: Feb. 27, 2003

Related U.S. Application Data

(60) Provisional application No. 60/407,645, filed on Sep. 3, 2002.

(51) Int. Cl.[7] ..... H01B 7/18; H01B 7/00

(52) U.S. Cl. ..... 174/102 R; 174/103; 174/110 R; 174/113 R

(58) Field of Search ..... 174/103, 113 R, 174/105 R, 36, 34, 102 R, 27

(56) References Cited

U.S. PATENT DOCUMENTS

| | | | | | |
|---|---|---|---|---|---|
| 4,376,920 | A | * | 3/1983 | Smith | 333/12 |
| 4,822,304 | A | * | 4/1989 | Herron | 439/610 |
| 5,176,536 | A | * | 1/1993 | Ganger et al. | 439/582 |
| 5,244,415 | A | * | 9/1993 | Marsilio et al. | 439/610 |
| 5,268,676 | A | * | 12/1993 | Asprey et al. | 345/169 |
| 5,459,283 | A | | 10/1995 | Birdwell, Jr. | |
| 5,483,656 | A | * | 1/1996 | Oprescu et al. | 713/320 |
| 5,491,299 | A | * | 2/1996 | Naylor et al. | 174/36 |
| 5,541,361 | A | * | 7/1996 | Friesen et al. | 174/34 |
| 5,694,081 | A | * | 12/1997 | Fiori, Jr. | 330/69 |
| 5,767,442 | A | * | 6/1998 | Eisenberg et al. | 174/36 |
| 6,114,632 | A | * | 9/2000 | Planas et al. | 174/117 R |
| 6,143,995 | A | * | 11/2000 | Ward | 200/51.05 |
| 6,271,472 | B1 | * | 8/2001 | Mattos et al. | 174/113 R |
| 6,310,286 | B1 | * | 10/2001 | Troxel et al. | 174/36 |
| 2003/0132022 | A1 | * | 7/2003 | Williams et al. | 174/113 R |

FOREIGN PATENT DOCUMENTS

JP 08-153545 A * 6/1996 ..... H01R/4/64

OTHER PUBLICATIONS

Telephone conversation with M. Mel Toburen—See Appendix of IDS.

New Product Bulletin, Introducing Belden® FleXnakeAudio ™Snake Cables, two pages, copyright 2000, Belden Inc.

Parts Express Electronics & More, Catalog No. 21, pp. 137 and 242, copyright 2002.

Carvin May 2002 catalog, p. 38, May 2002.

Musician's Workshop, web page, "Gear Talk . . . All About Ian's New Pedal Board", date unknown, printed Dec. 2002.

* cited by examiner

*Primary Examiner*—William H. Mayo, III

(74) *Attorney, Agent, or Firm*—Miller Patent Services; Jerry A. Miller

(57) ABSTRACT

A musical instrument snake cable that interconnects audio components for use with a musical instrument in a manner consistent with certain embodiments of the present invention has a plurality of shielded signal-carrying wire groups for carrying unbalanced signals between a frontline end and a backline end. An electrical connector terminates the frontline end and the backline end of each signal-carrying wire group. A power-carrying wire group is provided having frontline end and a backline end with first and second electrical connectors terminating the frontline end and the backline end of each power-carrying wire group. An insulating sleeve surrounds the plurality of shielded signal-carrying wire groups and the power-carrying wire group. In one embodiment, the shielded signal-carrying wire groups are each made up of a shielded twisted pair. The electric cable device preferably has the shield of at least one of the plurality of signal-carrying wire groups grounded at only one of the backline and the frontline ends to eliminate current traveling on the shield.

26 Claims, 4 Drawing Sheets

SNAKE FOR MUSICAL INSTRUMENT WIRING

CROSS REFERENCE TO RELATED DOCUMENTS

This application is related to and claims priority benefit of U.S. Provisional Patent Application Serial No. 60/407,645 filed Sep. 3, 2002, which is hereby incorporated herein by reference.

COPYRIGHT NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever.

FIELD OF THE INVENTION

This invention relates generally to the field of wiring connections for electronic musical instruments. More particularly, this invention in certain embodiments relates to a cable snake arrangement for routing signal and/or power between special effects devices and amplification systems.

BACKGROUND OF THE INVENTION

Electric guitarists and other musicians often enhance the sound of their instrument with special effects devices. Such special effects device may take the form of so called "stomp box" pedals or "rack units". Stomp boxes are effects pedals that turn on and off by stomping down on a switch with the foot or are otherwise operated with the musician's foot. Such devices modify or enhance the sound by adding echo, reverb, tone, phasing, or other sound-altering effects. Rack units provide similar functions, but are mounted in an equipment rack. Many rack units employ MIDI (Musical Instrument Digital Interface), and are often controlled from a MIDI foot pedal. The term "pedal" is used to generically refer to both effects devices themselves as well as remote foot pedals associated with rack units. The terms "stomp box" and "pedal" and "effects pedal" are used synonymously herein.

Such pedals are most commonly powered by a 9 VDC (Volts DC) power source. The power source can be either a battery or an external power source. In view of the relatively low amount of current required to power such devices, the power source often takes the form of a so called "wall wart." A wall wart is a transformer with electrical prongs that plug directly into a 120 VAC (in the United States) AC power outlet. The transformer reduces the AC voltage and converts it to DC to provide DC power to the effects device. Although most pedals use a standard 9 VDC battery, an external power source such as a wall wart is frequently used to replace the batteries, especially in systems that employ several pedals, because changing batteries can be costly and time consuming, and can disrupt a performance when a battery is expiring.

Wall warts can be problematic because their size, shape, and weight. Plugging a wall wart into a typical multiple-outlet AC power strip can be cumbersome, or impossible at times when other plugs are plugged into the power strip. This is due to the size of the transformer and close spacing of the outlets on the strip. Moreover, when a wall wart power source is plugged into a power outlet, it frequently covers another outlet preventing its use. More sophisticated power supplies are also available to provide multiple power outlets for multiple pedals. These supplies are often more expensive than wall wart type power supplies.

When more than one pedal is used by a guitarist, bass player or other musician, a pedal board is often employed to organize the pedals. A pedal board is a structure such as a rectangular (or other shape) board or case upon which multiple pedals are mounted. Multiple pedals are mounted onto the pedal board (a single platform), and power for all the pedals can then come from one or two power sources that are generally situated near the board and plugged into a multi-outlet AC power strip. The board is frequently located near a front area of the stage (the "frontline") for easy access by the musician. One or more connections are then made from the pedal board to the amplifier, which is usually located on the "backline"—a term for the back of the stage where the amplifiers are lined up to aim forward at the players (guitarists and any other musicians) at the front of the stage, and into the audience out front. Although a guitar-, bass- or other instrument-amplifier is the usual mechanism amplifying the sound of an electric guitar, other amplifying systems, such as a public address system can also be employed. When an instrument-amplifier is used, connections are often made between the pedal board and the amplifier's instrument input, as well as to and from an effects loop provided at the amplifier.

As a result of these multiple connections, many electrical cables may be needed to interface to the pedal board including (but not limited to) AC power extension cord to provide power to the warts, AC strip to plug in multiple warts, shielded audio cable from the output of the guitar to the first pedal input, shielded audio cable to output the pedal signal to the guitar amplifier input, shielded audio cable to output a signal to the amplifier's effects loop "return", shielded audio cable to input a signal from the amplifier's effects loop "send", a MIDI (Musical Instrument Digital Interface) cable, and/or other connections. If a wireless connection is used to connect to the musical instrument, a wireless receiver may also need a shielded audio cable connection to the pedal board, since such wireless receivers are often located at the backline along with the amplifier.

Such wiring between the frontline and the backline can be problematic since the wires generally run through a central stage area. Not only is the wiring unsightly, but it can be underfoot where it may be easily damaged or unplugged during a performance. Moreover, setup and teardown of the instrument amplification system can be slow and cumbersome due to all of the individual cables.

BRIEF DESCRIPTION OF THE DRAWINGS

The features of the invention believed to be novel are set forth with particularity in the appended claims. The invention itself however, both as to organization and method of operation, together with objects and advantages thereof, may be best understood by reference to the following detailed description of the invention, which describes certain exemplary embodiments of the invention, taken in conjunction with the accompanying drawings in which:

DETAILED DESCRIPTION OF THE INVENTION

Figure 1:
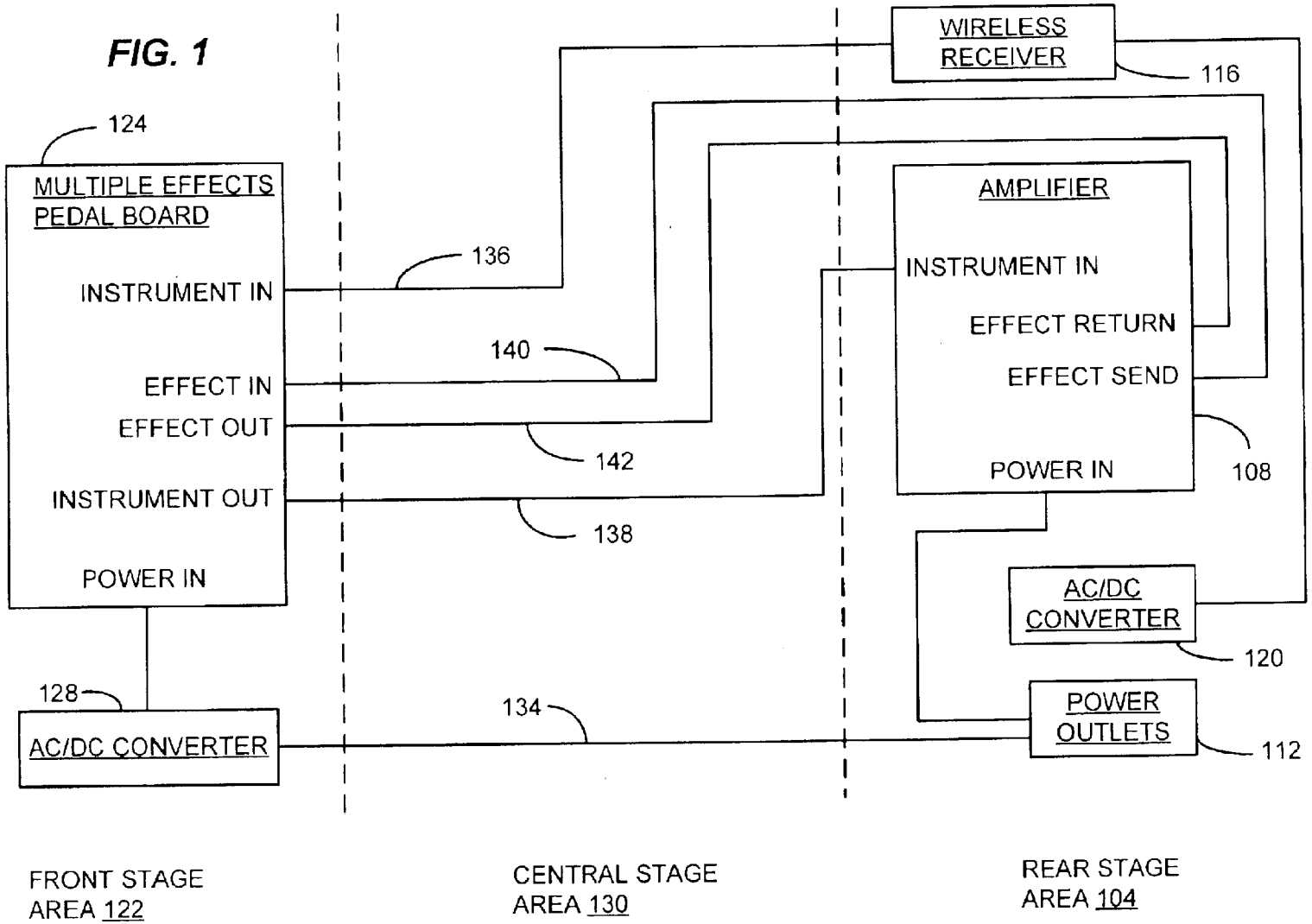
FIG. 1 is a schematic block diagram of an exemplary musical instrument setup.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals are used to describe the same, similar or corresponding parts in the several views of the drawings.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically. The term "wire group" is defined to mean a wire or collection of wires such as, for example, a shielded twisted pair or a coaxial cable, that are grouped together for a specified purpose.

FIG. 1 schematically depicts an exemplary wiring arrangement for a single musician. At the backline area 104 of the stage a musical instrument amplifier (e.g., a guitar amplifier) 108 receives AC power from a power outlet 112. A wireless transceiver 116 receives power from an AC to DC converter 120 that is plugged into a power outlet 112. At the frontline area 122 of the stage, a pedal board 124 resides along with an AC to DC converter 128 which powers the effects pedals situated on the pedal board.

To complete this setup, connections are made between the frontline equipment and the backline equipment using wiring that passes through the central area 130 of the stage. In this exemplary setup, AC power is provided from outlets 112 to converter 128 by passing an extension cord or power strip cord 134 through the central stage area 130. A shielded connection 136 is provided from the wireless receiver 116 to an instrument input of an effect pedal at the pedal board. An instrument output at an effects pedal in the pedal board is connected to the amplifier's instrument input also using a shielded cable 138. Certain effects are best connected through the amplifier's effects loop. Thus, two shielded cables, 140 and 142 respectively, are used to connect the effects send to an effect input at the pedal board and to connect an effect output at the pedal board to the effect return of the amplifier. Thus, for this setup, five cables are passed through the central stage area 130 to effect the setup.

Connecting this combination of cables can be time consuming to setup and plug in, problematic in operation and troubleshooting, unsightly, and creates cable-clutter underfoot that can be dangerous to performers and stage hands. This is especially, true given the fact that amplifiers such as 108 usually are placed on the "backline" and the pedal board is at the front of the stage. AC power outlets 112 (providing near 120 volts AC in the United States) are also usually found on the back wall behind the backline as well (or to the side of the stage), so most equipment needing AC power has power extension cords that plug in to a power outlet at the back or side of the stage. The pedal power converter(s) 128 at the front of the stage usually require long extension cords to reach power outlets 112 at the back or side, further adding to the clutter underfoot experienced by the player at the front of the stage.

Figure 2:
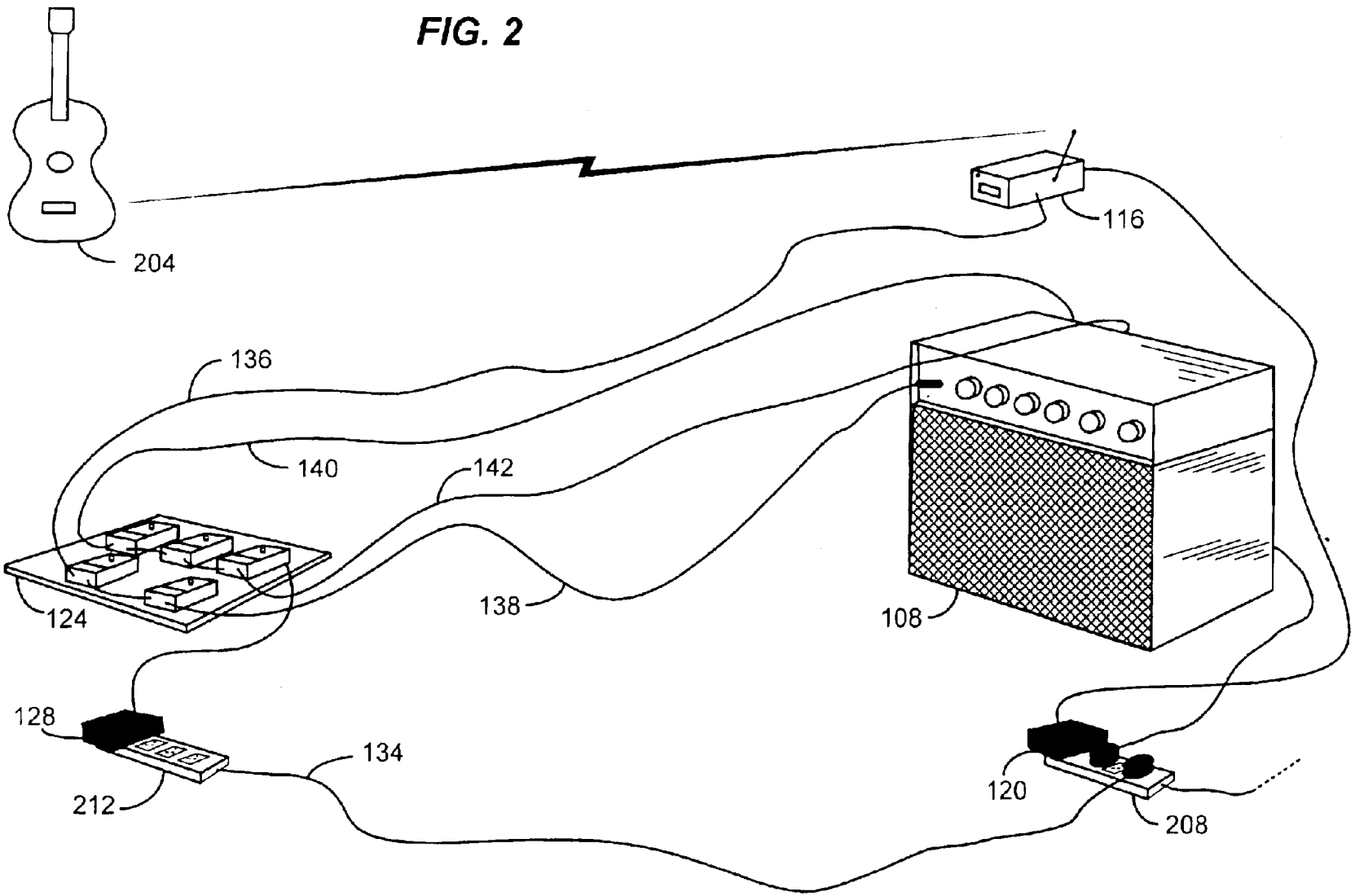
FIG. 2 is an illustration of a stage setup wired according to the schematic of FIG. 1.

FIG. 2 depicts the wiring arrangement for amplification of an electric guitar 204 more graphically to illustrate the wiring difficulties encountered in such a setup. In this depiction, a pair of power strips 208 and 212 are used to provide AC power to the backline and frontline respectively. Pedal board 124 is depicted with five effects pedals, some of which are chained together and connected ahead of the amplifier 108's instrument input and others of which are chained together and connected into the amplifier's effects loop.

As shown, discrete, individual signal and power cables are commonly used to run out to the pedal board. This is done for various reasons, including they can provide a relatively clean signal, they can be adequately free of noise and crosstalk, and they are readily commercially available. Bundling these cables together with tape or hook and loop straps can simplify setup and appearance, but the bundle can be very thick and difficult work with, and may produce cross talk and hum. Since each cable is generally a shielded unbalanced instrument cable that is typically on the order of 7.5 mm in diameter (for good quality cable), a bundle of four or more such cables can be quite stiff and unwieldy due to the relatively large size of the cables and large quantity of insulating jacket material. Such bundles may exceed 15 mm (0.59 inches) in diameter without supplying power to the pedalboard. Moreover, there is no mechanism in place for dealing with potential crosstalk and hum problems.

Individual cables remain the most common option because it is difficult to run power wires along side unbalanced audio signal wires within a long, single snake cable. It is also problematic to run signals at microphonic levels (e.g., the levels associated with a guitar pickup), along with line level signals (from the effects loop or connections with certain stomp boxes) and power lines. This is because power lines may induce hum into the audio signals, and line level signals may crosstalk into microphonic-level signals. The longer the connection, the worse these problems become.

While commercially available snake cables are available, their use has been limited to carrying balanced microphone level signals between a microphone mixing console and a frontstage area. Balanced signals at microphone levels are much less challenging to run long distances along side one another due to the noise rejection properties of balanced signals. The wire used in such commercially available balanced snake cables is compact in diameter (e.g., approximately 11 mm for six pairs of shielded twisted pair, manufactured by Belden, Richmond, Ind. as FleXsnake™ brand audio snake cable, trade number 1906A), flexible and durable. Such cable is approximately 20% narrower in diameter than four conventional coaxial audio cables bundled together and is designed to be flexible as a single cable. Because the signal carrying wires in this snake are closer together than in a simple bundle of cables, the potential for crosstalk is increased when carrying unbalanced signals. However, by using the disclosed grounding, shield connections and arrangement of the signal carrying wires, this crosstalk can be minimized or virtually eliminated, as will be seen upon consideration of the discussion below.

Figure 3:
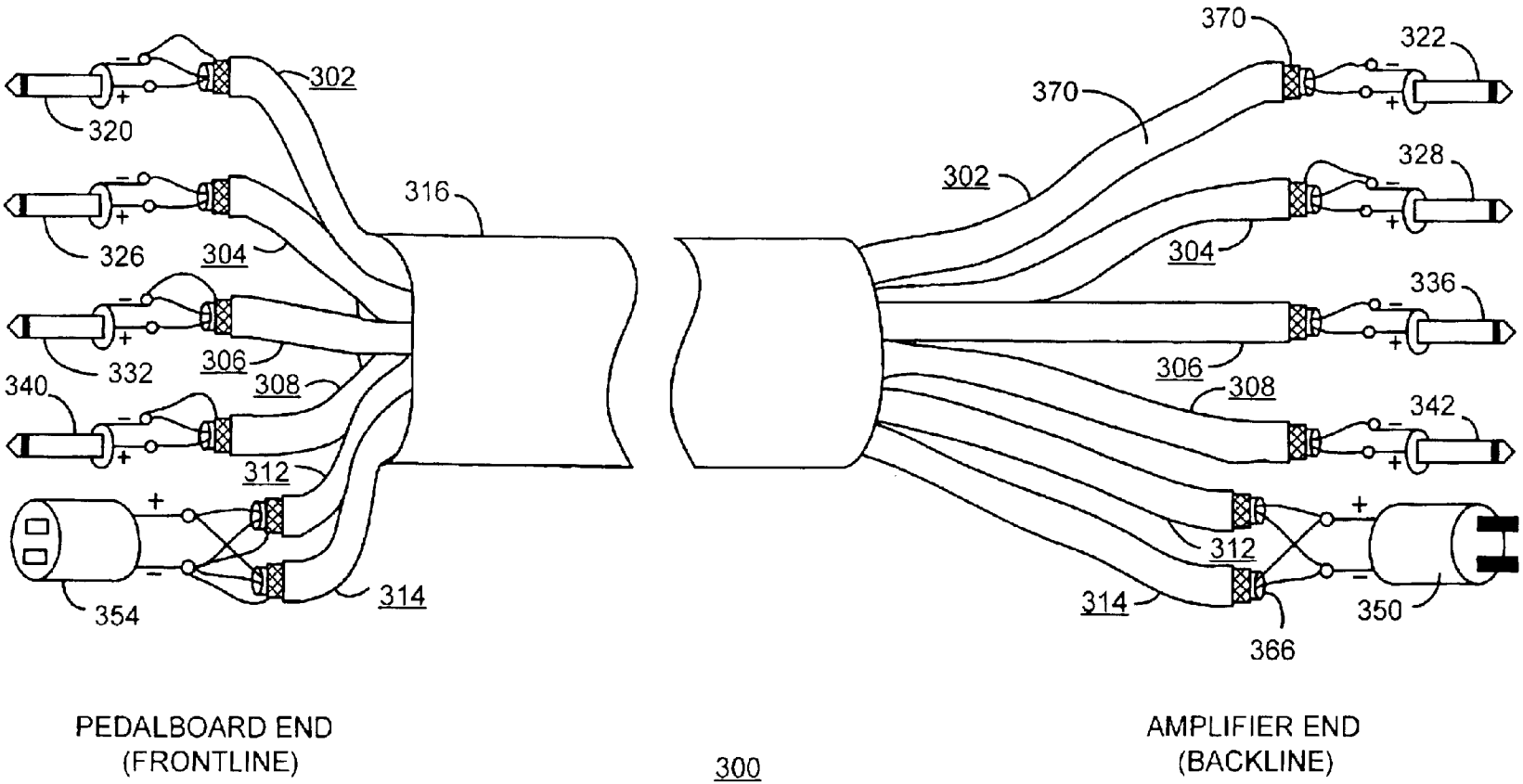
FIG. 3 is an illustration of the stage setup wired according to the schematic of FIG. 1 using a snake arrangement consistent with certain embodiments of the present invention.

In certain embodiments consistent with the present invention, a snake cable is provided which handles multiple audio signal functions at line and microphone levels along with power functions in a single compact arrangement. FIG. 3 depicts an exemplary embodiment of such a snake cable arrangement 300. A cable with six shielded twisted pairs is used here. Useful lengths of the cable are generally between approximately 15 and 30 feet, but this should not be considered limiting. One or more shielded pairs are dedicated to DC power, and the others provide audio and/or control signals to and from the pedal board. While AC power could be run through the snake to a DC power supply at the pedal board, AC can be problematic in terms of noise (60 cycle hum), safety, and the cost of minimizing these problems. However, properly designed, embodiments of the present snake could also provide AC power.

One end of the snake resides near the amplifier (the backline end), connecting to the amplifier and other entities near the amplifier; i.e., signal sources, rack units, and power sources. There, connections to the DC power source's output, the amplifier's effects loop, the amplifier input, and guitar wireless receiver unit can be made. The other end of the snake cable resides on, or near, the pedal board on stage (the frontline end), and connects power and signals to the pedals.

Signals may connect via standard, unbalanced musical instrument connections using ¼" phone plugs. Right angle varieties of these are usually preferred at the pedal board. DC power connectors can vary according to voltage, power supply, or manufacturer; or, multiple connectors can be supplied as different plug-ins to a cable that terminates in a generic connector receptacle. Most commercially available pedals use a standard barrel-style DC connector, and that example is used herein.

To minimize or prevent crosstalk and noise, all currents are eliminated on the cable pairs' shields. The cable shields are usually braided wire and/or foil, and surround the internal signal wire pair. In accordance with certain embodiment consistent with the present invention, within the shielded twisted pairs that carry the unbalanced musical instrument signals, the shields are connected to the negative of the signal pair, but only at one end. Therefore, all the shields are electrically connected to keep the noise-shielding effect intact, but carry no signal current from input-to-output. This prevents ground loops from causing audible hum and also prevents or minimizes the induction of crosstalk or noise into a nearby signal being carried within the snake cable. This ground current is carried on the negative wire of the signal pair within the surrounding shield. Which end of the shield gets connected (the "amplifier end" or the "pedal end") can vary. Some shields can connect at both ends without harm, if properly chosen to prevent ground loops, while others should only be connected at one end. The guitar amplifier, which is usually the largest AC power user in the system, should be studied before connecting a shield to both ends of a wire pair that connects to the amplifier. Otherwise, potential differences within the amplifier chassis may cause ground currents and 60 Hz hum. The preferred embodiment of the invention uses a shielding connection scheme that is good for most all guitar amplifier systems.

Thus, for the exemplary embodiment wiring snake illustrated in FIG. 3, four sets of shielded twisted pair cables 302, 304, 306 and 308 are provided, each representing a signal carrying group of wires and each having an insulating jacket surrounding the shielded pair cables. Two other sets of shielded twisted pair, 312 and 314, are used as power carrying wire groups that carry power between the frontline and backline. Shielded twisted cable pairs 302, 304, 306, 308, 312 and 314 are housed within an insulating jacket 316—an overall insulating jacket around the multiple signal carrying wires. In each of the signal carrying wire groups, a twisted pair of wires is connected to the tip and ring connection of a standard ¼" phone plug (in this example, but this should not be considered limiting), so that the tip connection of the plug at the frontline is connected to the tip connection of the plug at the backline. Similarly, the ring connection of the plug at the frontline is connected to the ring connection of the plug at the backline. This connection arrangement is used to connect plug 320 with 322, 326 with 328, 332 with 336, and 340 with 342. The signal carrying wire groups may be tagged or color coded to simplify connection and assure proper grounding.

In this exemplary embodiment, a 6-pair cable is used, but this should not be considered limiting. In prototypes, 20 feet of FleXsnake™ trade number 1906A cable manufactured by Belden can be used. Suitable cable for this example embodiment has six sets of twisted pairs of 24 guage wire which are individually shielded with shields such as 360 (but this exact configuration is not to be considered limiting). Such cables may incorporate a suitable strain relief (not shown) to minimize strain on the individual wires. Each twisted pair may or may not have an insulating jacket such as 366 between the twisted pair and the shield. Each shield should be individually insulated, with an insulating jacket such as jacket 370 of shielded twisted cable pairs 302, from the others to permit use of the grounding scheme described herein.

In order to avoid ground loops that can introduce hum (as will commonly occur when individual cables are used for each connection), the shield of the cable is only connected at a one end of each of the signal carrying wire groups. At one end of the snake 300 of the embodiment illustrated, the shield is connected to the ring side of the phone plugs 320, 332 and 340. The shield is left open (floating) at plug 326 and the return path for signal is exclusively on one of the twisted pairs (even though the signal is unbalanced). At the other end of the snake 300 of the embodiment illustrated, the shield is connected to the ring connection point of plug 328. At plugs 322, 336 and 342 the shield is left open (floating). This arrangement provides shielding to each of the signal carrying twisted pairs, by virtue of the shield being connected at one end, but prevents signal current from flowing in the shields. Thus, the shields function as shields while minimizing or eliminating crosstalk and hum.

For the power carrying wire groups, two sets of twisted pairs are used to carry DC current between the frontline and backline to minimize DC resistance and reactance in the wiring, as well as to provide redundancy in the DC power carrying wires. Cables 312 and 314 are wired in parallel to connect plug 350 to jack 354 and thus provide an avenue to route DC power to the pedal board. At the plug end, in this example, the shields are left floating and the plus and minus connections are made to the two sets of twisted pairs. At the other end, the two sets of twisted pair are appropriately paired up and connected to the plus and minus connections of jack 354. The shields are connected together to the minus connection of jack 354. In other embodiments, other arrangements of the power carrying wire groups are also possible consistent with the present invention.

The special shielding configuration taught herein may not be required on powered snakes with short lengths, balanced line signals, ultra-quiet power supplies, and/or ample distance between the wires within a larger diameter snake. These characteristics can sometimes adequately reduce noise and crosstalk on their own. However, the present shielding arrangement provides a musician with a thin, long, flexible snake that performs well in most all situations when carrying power (from standard wall warts or other DC power supplies) along with unbalanced signals of line- and microphonic-levels—signals common in the musical instrument environment. Such a thin, flexible audio snake is not only economical to build, but easy to setup and use. Moreover, the shielding arrangement shown not only provides better performance in all situations, it also reduces the number of shield connections that are made, thus reducing the labor cost to produce.

The preferred exemplary embodiment of this invention as described above has 6 sets of shielded twisted pairs 302, 304, 306, 308, 312 and 314. Four right angle ¼" (right angle not illustrated) phone plugs 320, 326, 332 and 340 are used at the pedal board end of the snake. Four straight ¼" plugs 322, 328, 336 and 342 are used at the amplifier end of the snake. Shrink tubing is added around all insulation cuts (not shown for clarity of illustration of the connections). Two barrel style DC power connectors 350 and 354 are used for the power connections.

The DC power connectors 350 and 354 of the present illustrative embodiment can be male and female versions of the barrel style connectors used by most effect pedal manufacturers. In one implementation, the snake 300 uses a flexible, 6-pair audio snake cable cut to a 20 foot length. The shielded pairs are individually insulated and are exposed as 18" pigtails at each end by stripping the outer jacket of the snake. Shrink tube surrounds the remaining pigtail/jacket interface, and the pigtails of each pair remain loose over the 18 inches to facilitate connections. There are no pairs dedicated to MIDI (Musical Instrument Digital Interface) signals in this example, but MIDI wiring could be readily provided, without departing from the present invention, by using multiple sets of twisted pairs to carry the MIDI signals and using the grounding scheme described herein. Two of the shielded pairs carry DC power as illustrated, and the remaining four pairs provide audio signals to and from the pedal board as follows:

1. Input to pedal board from the output of a guitar wireless receiver located on the backline. This signal pair would not be used if a musician uses a discrete cable directly from the guitar to the pedal board,
2. Output of pedal board (to amplifier input),
3. Input to pedals in the Effects Loop (from amplifier Effects Send output), and
4. Output from pedals in the Effects Loop (to amplifier Effects Return input)

In the present embodiment for convenience and space saving, right angle ¼" plugs connect signals at the pedals, and straight ¼" plugs connect signals at the amplifier end. If MIDI wiring is provided, suitable MIDI connectors can be used as desired. The DC power connectors are standard barrel style. However, these connector types are not to be limiting.

To reduce noise and crosstalk, the shields for each wiring pair are connected to ground at one end of the snake only as described above, not at both ends. Therefore, negligible current flows in the shield, minimizing crosstalk and reducing induced noise. However, each shield has a ground connection so that it remains effective as a shield. For this preferred embodiment, the shields of the snake pairs are connected in a manner consistent with the grounding pattern found in a typical guitar amplifier system. The connections are as called out in the following TABLE 1:

TABLE 1

SHIELD CONNECTION TABLE

| Cable | Description | Pedal Board end | Amp End |
|---|---|---|---|
| 302 | Input to pedal board from guitar output (or guitar wireless receiver's output) | connect | open |
| 304 | Output of pedal board (to amp input) | open | connect |
| 306 | Input to pedals in the Effects Loop (from amp Effects Send output) | connect | open |
| 308 | Output from pedals in the Effects Loop (to amp Effects Return input) | connect | open |
| 312, 314 | DC power to pedal board | connect | open |

Figure 4:
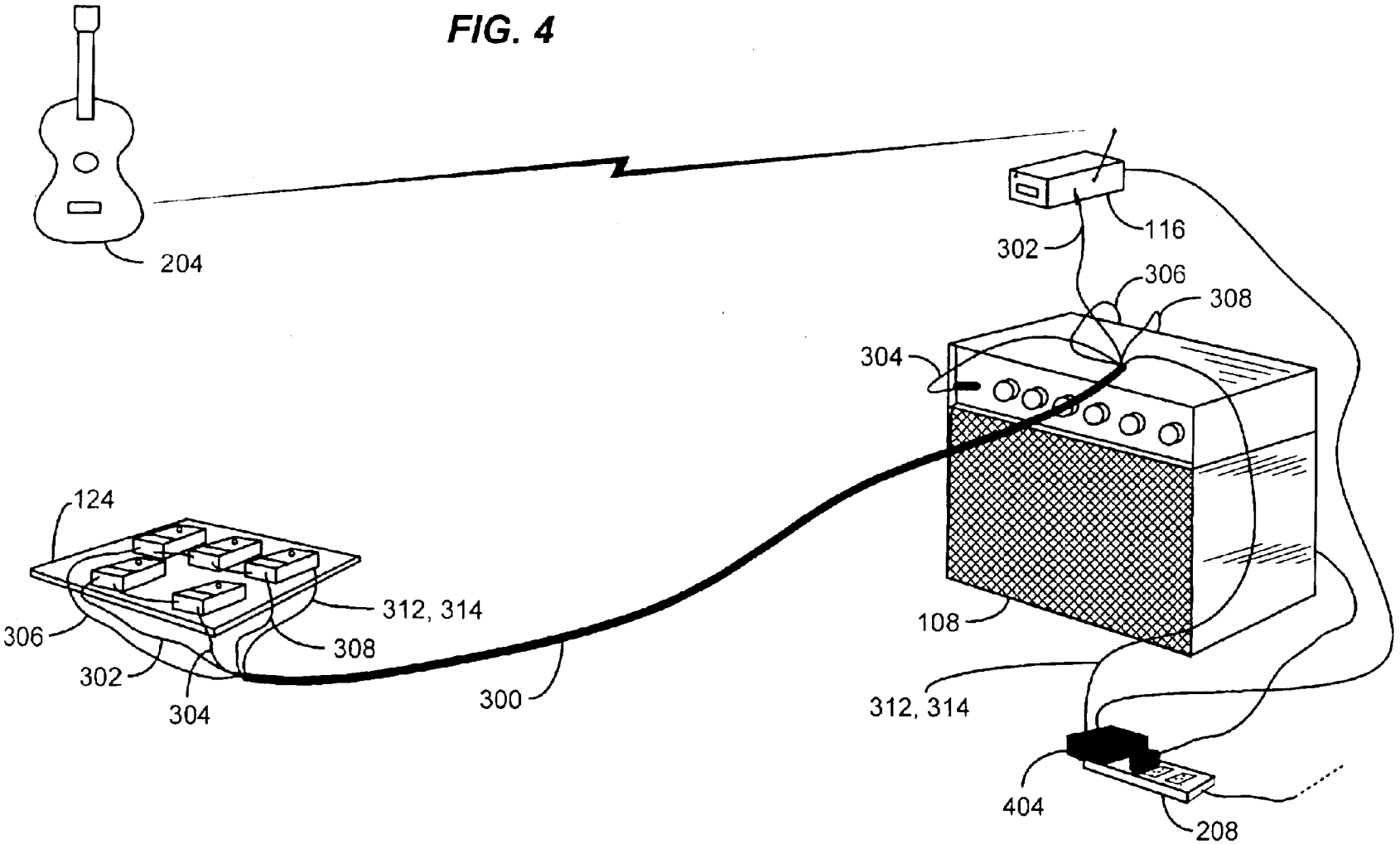
FIG. 4 is an exemplary electrical snake arrangement consistent with certain embodiments of the present invention.

FIG. 4 depicts the snake 300 in use in a stage setup to accomplish wiring similar to that of FIG. 2, except that all DC power is produced by AC to DC converter 404 at the backline area of the stage. The amplifier's instrument input is connected with cable 304 to the pedal board. The wireless receiver 116 is connected to the pedal board using cable 302. The effects loop is connected using cables 306 and 308. DC power is supplied through cables 312 and 314. Due to the shielding arrangement described above, this arrangement produces no audible crosstalk or hum, even though the snake 300 carries a mixture of DC, microphonic levels and line levels.

Those skilled in the art will appreciate that many variations in the invention can be made without departing from the invention. Some of the many design variations that will be apparent to those skilled in the art upon consideration of the present teachings (without limiting the scope of such variations) are: right angle or straight ¼" plugs can be provided at the pedal end, other types of connectors may be used and the snake length can vary. The snake can be used not only for electric guitars, but any appropriate application with audio-signal and DC-power may benefit from embodiments of the present invention. Power voltages and connectors may vary, the number of pairs, and the uses of them, may vary (e.g., a version with 2 or more DC power wire pairs, or with 2 or more DC voltages), and MIDI signal carrying wire groups may be used within the snake (may require more than one pair). While the present embodiment has been illustrated using a shielded twisted pair, other arrangements are also possible. In particular, in certain situations, it may be possible to use shielded coaxial audio cable with appropriate attention to grounding to avoid ground loops. If shielded coaxial audio cable is used, certain shield connections can still be left open to prevent ground loops, but the open shields must be determined by the exact configuration of the particular setup.

Therefore, an electric cable device that interconnects audio components for use with a musical instrument in a manner consistent with certain embodiments of the present invention has a plurality of shielded signal-carrying wire groups for carrying unbalanced signals between a frontline end and a backline end. An electrical connector terminates the frontline end and the backline end of each signal/carrying wire group. A power-carrying wire group is provided having frontline end and a backline end with first and second power connectors terminating the frontline end and the backline end of each power-carrying wire group. An insulating sleeve covers the plurality of shielded signal-carrying wire groups and the power-carrying wire group. In one embodiment, the shielded signal-carrying wire groups are each made up of a shielded twisted pair. The electric cable device preferably has the shield of at least one of the plurality of signal-carrying wire groups grounded at only one of the backline and the frontline ends to eliminate current traveling on the shield.

Thus, in certain embodiments consistent with the present invention, multipair, balanced audio "snake" cable is used to carry unbalanced, microphonic-level guitar signals, unbalanced line-level effects signals, digital control signals, and power, all at once. A special shielding configuration, tailored to the electrical properties of an electric guitar/amplifier/effects-pedal system, is employed to reduce noise and crosstalk between the various unbalanced musical instrument signals and power wires within the snake, and allow the snake to be used effectively in most all musical instrument systems and environments The exemplary embodiment of the invention as taught herein, provides a "one cable solution" that gives the musician a single large, flexible cable running to the pedal board rather than multiple connection cables. This permits quicker setup and teardown and leads to less clutter underfoot to provide a neater appearance, greater protection for the wiring and less individual wiring to trip a performer. No thick AC power cables are needed near pedal board, and no multi-outlet power strip needed near the pedal board.

While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations as fall within the scope of the appended claims.

What is claimed is:

1. A musical instrument snake cable that interconnects audio components for use with a musical instrument, comprising:

a multiple wire group audio cable having:

a plurality of shielded signal-carrying wire groups for carrying unbalanced signals between a frontline end and a backline end, with each of the signal-carrying wire groups having an insulator surrounding the shield;

a power-carrying wire group having frontline end and a backline end;

a plurality of electrical connectors, one terminating each of the frontline end and the backline end of each of the signal-carrying wire groups;

first and second power connectors terminating the frontline end and the backline end of each power-carrying wire group; and an insulating sleeve surrounding the plurality of shielded signal-carrying wire groups and the power-carrying wire group.

2. The musical instrument snake cable according to claim 1, wherein the shielded signal-carrying wire groups each comprise a shielded twisted pair, with the unbalanced signals being carried between the frontline and the backline on the twisted pair.

3. The musical instrument snake cable according to claim 2, wherein the shield of at least one of the plurality of signal-carrying wire groups is grounded at only one of the backline and the frontline ends.

4. The musical instrument snake cable according to claim 2, wherein the shield of one of the plurality of signal-carrying wire groups is grounded at only the backline end, and all others of the shields of the plurality of signal-carrying wires is grounded at the frontline end.

5. The musical instrument snake cable according to claim 1, wherein at least one of the signal carrying wire groups carries a MIDI signal.

6. The musical instrument snake cable according to claim 1, wherein the power-carrying wire group delivers DC power from the backline end to the frontline end.

7. The musical instrument snake cable according to claim 1, wherein the power-carrying wire group has a shield and wherein the power-carrying wire group has an insulator surrounding the shield.

8. The musical instrument snake cable according to claim 1, wherein the power-carrying wire group delivers AC power from the backline end to the frontline end.

9. The musical instrument snake cable according to claim 1, wherein each of the plurality of signal-carrying wire groups has a surrounding insulating jacket.

10. The musical instrument snake cable according to claim 1, wherein the electrical connectors comprise ¼" phone plugs.

11. The musical instrument snake cable according to claim 1, further comprising a DC power source connected to the power carrying wire group.

12. The musical instrument snake cable according to claim 1, wherein the shielded signal carrying and power carrying wire groups each comprise a coaxial cable having a single conductor surrounded by a shield.

13. The musical instrument snake cable according to claim 12, wherein the shield of at least one of the plurality of signal carrying and power carrying wire groups is grounded at only one of the backline and the frontline ends.

14. An musical instrument snake cable that interconnects audio components for use with a musical instrument, comprising:

a multiple wire group audio cable having:

a plurality of shielded signal-carrying wire groups for carrying signals between a frontline end and a backline end, wherein the shielded signal-carrying wire groups each comprise a shielded twisted pair, with each of the signal-carrying wire groups having an insulator surrounding the shield;

a power-carrying wire group having frontline end and a backline end;

a ¼" phone plug connector terminating each of the frontline end and the backline end of each signal-carrying wire group;

first and second power connectors terminating the frontline end and the backline end of each power-carrying wire group; and an insulating sleeve surrounding the plurality of shielded signal-carrying wire groups and the power-carrying wire group.

15. The musical instrument snake cable according to claim 14, wherein unbalanced signals are carried between the frontline and the backline on the twisted pair.

16. The musical instrument snake cable according to claim 14, wherein the shield of at least one of the plurality of signal-carrying wire groups is grounded at only one of the backline and the frontline ends.

17. The musical instrument snake cable according to claim 14, wherein the shield of one of the plurality of signal-carrying wire groups is grounded at only the backline end, and all others of the shields of the plurality of signal-carrying wires is grounded at the frontline end.

18. The musical instrument snake cable according to claim 14, wherein at least one of the signal carrying wire groups carries a MIDI signal.

19. The musical instrument snake cable according to claim 14, wherein the power-carrying wire group delivers DC power from the backline end to the frontline end.

20. The musical instrument snake cable according to claim 14, wherein the power-carrying wire group has a shield and wherein the power-carrying wire group has an insulator surrounding the shield.

21. The musical instrument snake cable according to claim 14, wherein the power-carrying wire group delivers AC power from the backline end to the frontline end.

22. The musical instrument snake cable according to claim 14, wherein each of the plurality of signal carrying wire groups has a surrounding insulating jacket.

23. The musical instrument snake cable according to claim 14, further comprising a DC power source connected to the power carrying wire group.

24. An musical instrument snake cable that interconnects audio components for use with a musical instrument, comprising:

a multiple wire group audio cable having:

a plurality of shielded signal-carrying wire groups for carrying unbalanced signals between a frontline end and a backline end, wherein the shielded signal-carrying wire groups each comprise a shielded twisted pair that carries the unbalanced signals, and with each of the signal carrying wire groups having an insulator surrounding the shield;

a power-carrying wire group having frontline end and a backline end, wherein the power-carrying wire group delivers DC power from the backline end to the frontline end, and wherein the power-carrying wire group has a shield with an insulator surrounding the shield;

a right angle ¼" phone plug connector terminating the frontline end and a straight ¼" phone plug connector terminating the backline end of each signal-carrying wire group, wherein the shield of at least one of the plurality of signal-carrying wire groups is grounded at only one of the backline and the frontline ends;

first and second barrel-type power connectors terminating the frontline end and the backline end of each power-carrying wire group; and an insulating sleeve surrounding the plurality of shielded signal-carrying wire groups and the power-carrying wire group.

25. The musical instrument snake cable according to claim 24, wherein the shield of one of the plurality of signal-carrying wire groups is grounded at only the backline end, and all others of the shields of the plurality of signal-carrying wires is grounded at the frontline end.

26. The musical instrument snake cable according to claim 24, wherein at least one of the signal carrying wire groups carries a MIDI signal.

* * * * *